US005919319A

United States Patent [19]

Couderchon

[11] Patent Number: 5,919,319

[45] **Date of Patent: *Jul. 6, 1999**

[54] IRON-COBALT ALLOY, PROCESS FOR MANUFACTURING A STRIP MADE OF IRON-COBALT ALLOY, AND STRIP OBTAINED

[75] Inventor: Georges Couderchon, Sauvigny les Bois, France

[73] Assignee: Imphy S.A., Puteaux, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/782,948

[22] Filed: Jan. 13, 1997

[30] Foreign Application Priority Data

Jan. 11, 1996 [FR] France ..... 96 00232

[51] Int. Cl.[6] ..... H01F 1/04

[52] U.S. Cl. ..... 148/311; 148/307; 148/308; 148/309; 148/321; 148/546; 148/599; 420/80; 420/78; 420/103; 420/117

[58] Field of Search ..... 420/77, 78, 80, 420/103, 117; 148/546, 599, 321, 307, 311, 308, 309

[56] References Cited

U.S. PATENT DOCUMENTS

| | | | |
|---|---|---|---|
| 4,059,462 | 11/1977 | Masumoto et al. | 148/120 |
| 5,425,912 | 6/1995 | Smith et al. . | |

FOREIGN PATENT DOCUMENTS

| | | |
|---|---|---|
| C-705 516 | 3/1941 | Germany . |
| 61-253348 | 11/1986 | Japan . |
| 62-260001 | 11/1987 | Japan . |
| 63-233507 | 9/1988 | Japan . |
| 6033199 | 2/1994 | Japan . |

OTHER PUBLICATIONS

Patent Abstracts of Japan, vol. 17, No. 042 (C–1020) Dated Jan. 26, 1993 and JP–A–04 259355 (Hitachi Metal Precision Ltd.) Sep. 14, 1992.

Patent Abstracts of Japan, vol. 14, No. 228 (M–973) dated May 15, 1990 and JP–A–02 057608 (Kawasaki Steel Corp.), Feb. 27, 1990.

*Primary Examiner*—Sikyin Ip

*Attorney, Agent, or Firm*—Oblon, Spivak, McClelland, Maier & Neustadt, P.C.

[57] ABSTRACT

An Iron-cobalt alloy, whose chemical composition contains, by weight:

$5\% \leqq Co \leqq 40\%$ $0\% \leqq Si \leqq 5\%$ $0.2\% \leqq Al \leqq 5\%$ $0.5\% \leqq Si+Al \leqq 5\%$ the balance being iron and impurities resulting from the smelting. Process for manufacturing a strip and strip obtained.

13 Claims, No Drawings

IRON-COBALT ALLOY, PROCESS FOR MANUFACTURING A STRIP MADE OF IRON-COBALT ALLOY, AND STRIP OBTAINED

BACKGROUND OF THE INVENTION

Field of the Invention

The present invention relates to an iron-cobalt alloy. The invention alloy is particularly useful for the manufacture of magnetic circuits in electrical-engineering machines. A process for manufacturing articles, strips, etc. using the invention alloy also makes up part of the invention as does a sheet comprising the invention alloy coated with an electrically insulating layer.

Discussion of the Art

Electrical-engineering machines, such as electric motors, transformers or relays, include magnetic circuits consisting of stacks of pieces cut out from strips made of alloy whose magnetic properties are adapted. The greater the specific energy of the machines the better must be these properties, this being the case, for example, for machines on board vehicles such as airplanes or high-speed trains. This is because for these applications it is necessary to reduce to a minimum the weight of the equipment by increasing the specific energy, that is to say the power per unit of mass.

The magnetic circuits of machines having a high specific energy are often manufactured from an iron-cobalt alloy whose chemical composition comprises, by weight, approximately 50% of cobalt and 2% of vanadium, the balance being iron and impurities. However, these alloys have several drawbacks because they all exhibit an $\alpha$-$\gamma$ phase transformation which very appreciably limits the scope of varying the magnetic properties by heat treatment. In addition, these alloys generally have too low an electrical resistivity and are too expensive.

It has been proposed, especially in DE-C-705 516, to use iron-cobalt-silicon alloys containing from 2% to 18% of cobalt and from 1% to 6% of silicon. However, these alloys do not provide a satisfactory solution to the problem mentioned hereinabove. This is because, in order to obtain satisfactory magnetic properties, it is necessary that the alloy contain more than 3% of silicon. It then becomes very brittle and can no longer be cold-rolled satisfactorily, it therefore no longer being possible to obtain the low thicknesses which are desirable in order to reduce the eddy-current losses in the magnetic circuits.

SUMMARY OF THE INVENTION

One object of the present invention is to remedy these drawbacks by providing an alloy of the iron-cobalt type which has magnetic properties similar to those of the known alloys, but with a lower cobalt content so as to be less expensive than the existing alloys and able to be cold-rolled.

For this purpose, the subject of the invention is an iron-cobalt alloy, whose chemical composition comprises, by weight:

$5\% \leqq Co \leqq 40\%$ $0\% \leqq Si \leqq 5\%$ $0.2\% \leqq Al \leqq 5\%$ $0.5\% \leqq Si+Al \leqq 5\%$ the balance being iron and impurities resulting from the smelting.

The impurities resulting from smelting may be, especially, elements such as chromium, titanium, germanium, vanadium and molybdenum, and elements such as carbon, oxygen, nitrogen, sulfur and phosphorus.

Preferably, the carbon, oxygen, nitrogen, sulfur and phosphorus impurities resulting from smelting have contents less than the following values:

$C \leqq 0.03\%$ $O \leqq 0.005\%$ $N \leqq 0.003\%$ $S \leqq 0.003\%$ $P \leqq 0.003\%$ and the sum of the chromium, titanium, germanium, vanadium and molybdenum contents is preferably less than 0.5%.

Also preferably, the chemical composition satisfies one or more of the following relationships: $10\% \leqq Co \leqq 35\%$, $Si \geqq 2.5\%$ or $Al \geqq 1.5\%$ or $Si+Al \geqq 1.5\%$. Invention amounts of Co, Si and Al include all values between the broadest ranges given above. For example, for Co: 10, 15, 20, 25, 30 and 35%; for Si: 1, 2, and 3%; for Al: 0.5, 1, 2, 3 and 4%; for Si+Al: 1, 2, 3 and 4%. All ranges between all vales given are also included as part of the invention: e.g., 5–10% Co, which includes 5% and 10% and all values therebetween.

The invention also relates to a process for manufacturing an article, a strip, etc. made of an alloy in accordance with the invention, according to which process:

the alloy is smelted either under vacuum or in an arc furnace followed by an in-ladle metallurgy operation (e.g., degassing under vacuum to a final pressure of, e.g., 1 Torr (0.019337 psi), for, e.g., 5–50 min, preferably 20 min) and, optionally, after a first solidification, the alloy is remelted under vacuum or under an electrically conductive slag, in order to obtain an intermediate product;

the intermediate product is hot-rolled in order to obtain a hot-rolled article as desired, including, for example, a strip whose thickness is between 1 and 6 mm;

the hot-rolled article (strip) is pickled, optionally reheated between 200° C. and 600° C. and rolled in order to obtain a cold-rolled article (strip preferably having a thickness of between 0.05 mm and 0.5 mm);

a heat treatment between 850° C. and 1200° C. for 1 to 10 hours is carried out and a coating, with an electrically insulating layer, is applied.

The coating with an electrically insulating layer, preferably having a layer thickness of less than 5 $\mu$m, is preferably obtained by covering the strip either, after the heat treatment, with at least one layer of inorganic or organic varnish, or, before the heat treatment, with at least one layer of magnesium methoxide. Useful inorganic and organic varnishes are described in and meet ASTM A-345-84, incorporated herein in reference.

When the silicon content of the alloy is greater than 2%, the coating with an insulating layer is preferably obtained by applying a milk of magnesia to the strip before the heat treatment.

Finally, the invention relates to a sheet made of an alloy according to the invention, coated with at least one electrically insulating layer preferably less than 5 $\mu$m thick, having preferably a cubic (100)[001] texture or a (110)[001] texture, as well as to its use for the manufacture of an electrical-engineering machine.

DESCRIPTION OF THE PREFERRED EMBODIMENTS

The invention will now be described in a more specific but non-limiting way.

The inventors have discovered that by adding aluminum to an iron-cobalt alloy, which optionally contains silicon, the resistivity of the alloy was substantially increased without decreasing the saturation magnetization too much and that, by suitably choosing the content of this element, taking into account the optional silicon content, the α-γ phase transformation could be made to disappear while still obtaining a material which is sufficiently ductile for it to be able to be cold-rolled. This makes it possible to obtain a strip whose magnetic properties may be improved by a heat treatment and by obtaining a favorable texture.

Apart from iron and the impurities resulting from smelting, the chemical composition of the alloy according to the invention comprises, by weight:

from 5% to 40% and preferably from 10% to 35% of cobalt, which is the only known element able to improve the saturation magnetization of iron; since cobalt is a very expensive element, its content may be adjusted, for each particular application, to the content just necessary for obtaining the magnetic properties desired for the application;

from 0.2% to 5% of aluminum and from 0% to 5% of silicon in order to reduce the extent of the range of existence of the γ phase; aluminum has the additional advantage of increasing the electrical resistivity and of not impairing the cold ductility; silicon, which also reduces the range of existence of the γ phase, has, however, the drawback of making the cold-rolling operations difficult; preferably, the aluminum content is greater than or equal to 1.5% or the silicon content is greater than or equal to 2.5% or the sum of the silicon and aluminum contents is greater than or equal to 1.5%, as beyond these values the γ phase no longer exists, which allows high-temperature heat treatments in order to cause grain coarsening and to develop a favorable texture, and thus to improve the magnetic properties.

The impurities resulting from smelting are, especially, elements such as chromium, titanium, germanium, vanadium and molybdenum which may be tolerated as long as the sum of their contents preferably remains less than 0.5%. The impurities are also elements such as carbon, oxygen, nitrogen, sulfur and phosphorus whose contents should be as small as possible and, preferably, such that: $C \leqq 0.03\%$, $0 \leqq 0.005\%$, $N \leqq 0.003\%$, $S \leqq 0.003\%$ and $P \leqq 0.003\%$.

In order to obtain a sufficient purity level, the alloy may be smelted in a vacuum furnace or in an arc furnace followed by an in-ladle vacuum treatment and then cast in the form of an intermediate product. Advantageously, the alloy may be remelted under vacuum or under an electrically conductive slag. In this case, after vacuum smelting or after the in-ladle vacuum treatment operation, the alloy is cast in the form of a remelting electrode which is remelted under vacuum or under an electrically conductive slag in order to obtain the intermediate product.

The still hot intermediate product is transferred to a reheat furnace in order to be raised to the rolling temperature, and then hot-rolled in order to obtain, e.g., a hot-rolled strip having a thickness of between approximately 1 mm and approximately 6 mm. The hot-rolled strip is then pickled, then, optionally, warmed up by heating between 200° C. and 600° C. and, finally, cold-rolled (or warm-rolled, when the strip is warmed up) in several passes with, optionally, intermediate annealing operations between 700° C. and 1100° C. in order to obtain a cold-rolled strip generally having a thickness of between 0.05 mm and 0.5 mm.

In some cases, the succession of cold-rolling and intermediate-annealing operations makes it possible to obtain a (100)[001] cubic texture or a (110)[001] texture, these textures being particularly favorable for obtaining good magnetic properties. In order to avoid oxidation of the aluminum or silicon, the intermediate annealing operations must preferably be carried out in an atmosphere of pure dry hydrogen.

Next, the cooled-rolled strip is subjected to a heat treatment consisting of heating and holding at a temperature of between 850° C. and 1200° C. for a time of between 1 hour and 10 hours and coated with at least one electrically insulating layer. The heat treatment, which is carried out in an atmosphere of pure dry hydrogen, allows grain coarsening, which improves the magnetic properties.

At least one electrically insulating layer may comprise or consist of an inorganic or organic varnish, deposited after the heat treatment, or of magnesium methoxide, deposited before the heat treatment.

When the silicon content of the alloy is high enough, that is to say greater than 2%, at least one electrically insulating layer may be obtained by applying a milk of magnesia to the strip before the heat treatment. During the heat treatment, the silicon lying at the surface of the strip reacts with the magnesia to form an insulating glass.

The strips thus obtained may be cut in order to obtain pieces which, after stacking, form magnetic circuits for transformers, electric motors, relays or any other electrical-engineering machine.

These strips have a low coercive field ($Hc<0.55$ Oe; 1 Oe=79.577 A/m) and a high electrical resistivity ($\rho>33$ $\mu.\Omega.$cm), which makes them particularly suitable for manufacturing magnetic circuits for electrical-engineering machines having a high specific energy, these being intended especially for equipping vehicles such as high-speed trains or aircraft.

EXAMPLES

By way of non-limiting example, alloys C to F were manufactured (chemical composition in % by weight):

| alloy | Fe | Co | Si | Al | C | N | O | S |
|---|---|---|---|---|---|---|---|---|
| C | bal | 15 | — | 1.54 | 0.016 | 0.0008 | 0.001 | 0.0005 |
| D | bal | 15 | — | 2.4 | 0.027 | 0.0005 | 0.001 | 0.0005 |
| E | bal | 15 | — | 3.1 | 0.011 | 0.0005 | 0.001 | 0.0005 |
| F | bal | 15 | 0.98 | 1.55 | 0.011 | 0.0012 | 0.0013 | 0.0005 |

All these alloys were smelted in a vacuum furnace, hot-rolled and then cold-rolled in order to obtain strips 0.2 mm in thickness. The strips were subjected to a heat treatment in hydrogen. A coating layer of methylate of magnesium was provided. The heat-treatment conditions and the magnetic properties obtained were:

| alloy | Θ° C. | t (hours) | ρ($\mu.\Omega.$ cm) | B to 600 Oe (G) | Hc (Oe) |
|---|---|---|---|---|---|
| C | 900 | 4 | 35 | 22,100 | 0.5 |
| C | 1050 | 4 | 35 | 22,100 | 0.53 |
| D | 900 | 4 | 38 | 21,200 | 0.53 |
| D | 1150 | 4 | 38 | 21,200 | 0.4 |
| E | 900 | 4 | 40 | 21,000 | 0.43 |
| E | 1150 | 4 | 40 | 21,000 | 0.4 |
| F | 900 | 4 | 39.5 | 21,500 | 0.4 |
| F | 1000 | 4 | 39.5 | 21,500 | 0.32 |

By way of comparison, a strip made of an iron-cobalt alloy according to the prior art (reference A) was manufactured, the chemical composition of which was:

| alloy | Fe | Co | Si | Al | C | N | O | S |
|---|---|---|---|---|---|---|---|---|
| A | bal | 15 | 0.98 | — | 0.01 | 0.0014 | 0.0027 | 0.0005 |

The same coating as in C-F was provided. After heat treatment at 900° C. and 1000° C., their properties were:

| alloy | Θ° C. | t (hours) | ρ(μ.Ω. cm) | B to 600 Oe (G) | Hc (Oe) |
|---|---|---|---|---|---|
| A | 900 | 4 | 30 | 22,500 | 0.58 |
| A | 1000 | 4 | 30 | 22,500 | 0.71 |

It was found that the alloys according to the invention have a higher resistivity, a lower coercive field and a magnetization comparable to that of alloy A.

In general, the iron-cobalt alloys according to the prior art contain more than 15% of cobalt and the properties of the strips made of these alloys are typically:

| Co % | ρ(μ.Ω. cm) | B to 600 Oe (G) | Hc (Oe) |
|---|---|---|---|
| 50 | 40 | 22,500 | 1 |
| 25 | 22 | 22,500 | 1.5 |

It is found that the alloys according to the invention have a comparable electrical resistivity, a substantially lower coercive field and a quite similar magnetization despite a cobalt content which is very substantially lower. These results show some of the advantages of the alloy according to the invention.

French patent application 96 00 232 filed Jan. 11, 1996 is incorporated herein by reference.

What is claimed as new and is desired to be secured by: LETTERS PATENT OF THE UNITED STATES IS:

1. An iron-cobalt alloy, whose chemical composition consists, by weight:

$5\% \leqq Co \leqq 40\%$ $0\% \leqq Si \leqq 3\%$ $0.2\% \leqq Al \leqq 5\%$ 0.5% Si+Al5% the balance being iron and impurities resulting from smelting; wherein chromium, titanium, germanium, vanadium and molybdenum impurities resulting from smelting have contents whose sum is less than 0.5%; and wherein the coercivity field Hc is less than 0.55 Oe and the electrical resistivity is higher than 33 μΩcm.

2. The alloy as claimed in claim 1, wherein carbon, oxygen, nitrogen, sulfur and phosphorus impurities resulting from smelting have the following values:

$C \leqq 0.03\%$ $O \leqq 0.005\%$ $N \leqq 0.003\%$ $S \leqq 0.003\ \%$ $P \leqq 0.003\ \%$.

3. The iron-cobalt alloy as claimed in claim 1, wherein the magnetic induction is greater than or equal to 21,000 G.

4. The alloy as claimed in claim 1, wherein:

$10\% \leqq Co \leqq 35\%$.

5. The alloy as claimed in claim 1, wherein:

$Si \geqq 2.5\%$.

6. The alloy as claimed in claim 1, wherein:

$Al \geqq 1.5\%$.

7. The alloy as claimed in claim 1, wherein:

$Si+Al \geqq 1.5\%$.

8. A process for manufacturing a strip made of an alloy whose chemical composition consists of, by weight:

$5\% \leqq Co \leqq 40\%$ $0\% \leqq Si3\%$ $0.2\% \leqq Al \geqq 5\%$ $0.5\% \leqq Si+Al \leqq 5\%$ the balance being iron and impurities resulting from smelting wherein chromium, titanium, germanium, vanadium and molybdenum impurities resulting from smelting have contents whose sum is less than 0.5% comprising the steps of:

smelting the alloy either under vacuum or in an arc furnace followed by an in-ladle metallurgy operation and, optionally, after a first solidification, remelting the alloy under vacuum or under an electrically conductive slag, in order to obtain an intermediate product;

hot rolling the intermediate product in order to obtain a hot-rolled strip whose thickness is between 1 and 6 mm;

pickling the hot-rolled strip, optionally reheating between 200° C.. and 600° C. and rolling the pickled strip in order to obtain a cold-rolled strip;

subjecting the cold-rolled strip to a heat treatment between 850° C. and 1200° C. for 1 to 10 hours and coating the strip with at least one insulating layer wherein the product strip having the coercivity field Hc is less than 0.55 Oe, and the electrical resistivity is higher than 33 μΩcm.

9. The process as claimed in claim 8, wherein the coating with an insulating layer is accomplished by covering the strip either, after the heat treatment, with at least one layer of inorganic or organic varnish, or, before the heat treatment, with at least one layer of magnesium methoxide.

10. The process as claimed in claim 8, wherein, when the silicon content of the alloy is greater than 2%, the coating with an insulating layer is obtained by applying a milk of magnesia to the strip before the heat treatment.

11. A strip made according to the process as claimed in claim 8.

12. The strip as claimed in claim 11, which has a (100)[001] cubic texture or a (110)[001] texture.

13. The method of claim 8, wherein said pickled strip is reheated and rolled in order to obtain a cold-rolled strip having a thickness of from 0.05 mm to 0.5 mm.

* * * * *